US009652941B2

(12) United States Patent
Johnson

(10) Patent No.: US 9,652,941 B2
(45) **Date of Patent: *May 16, 2017**

(54) LOTTERY-TYPE GAME BASED UPON AT LEAST TWO CASINO GAMES

(71) Applicant: TIPPING POINT GROUP, LLC, Las Vegas, NV (US)

(72) Inventor: Sam Johnson, Las Vegas, NV (US)

(73) Assignee: Tipping Point Group, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/204,764

(22) Filed: Jul. 7, 2016

(65) Prior Publication Data

US 2016/0321856 A1 Nov. 3, 2016

Related U.S. Application Data

(63) Continuation of application No. 13/932,148, filed on Jul. 1, 2013, now Pat. No. 9,449,469.

(60) Provisional application No. 61/691,001, filed on Aug. 20, 2012, provisional application No. 61/713,904, filed on Oct. 15, 2012.

(51) Int. Cl.
*G07F 17/32* (2006.01)

(52) U.S. Cl.
CPC ..... *G07F 17/329* (2013.01); *G07F 17/3211* (2013.01); *G07F 17/3262* (2013.01)

(58) Field of Classification Search
CPC ... G07F 17/326; G07F 17/3262; G07F 17/329
USPC ..... 463/16–20
See application file for complete search history.

(56) References Cited

U.S. PATENT DOCUMENTS 4,448,419 A * 5/1984 Telnaes ..... G07F 17/3244 273/143 R
4,842,278 A * 6/1989 Markowicz ..... A63F 3/081 463/18
5,129,652 A * 7/1992 Wilkinson ..... A63F 3/06 273/138.1
5,158,293 A * 10/1992 Mullins ..... A63F 3/069 273/139
5,273,281 A * 12/1993 Lovell ..... A63F 3/065 273/138.1

(Continued)

OTHER PUBLICATIONS

Notification of Transmittal of the International Search Report and the Written Opinion of the International Searching Authority, or the Declaration for PCT/US2013/055437 mailed Nov. 13, 2013, 11 pages.

*Primary Examiner* — Michael Cuff
(74) *Attorney, Agent, or Firm* — Weide & Miller, Ltd.

(57) ABSTRACT

A lottery-type game is enabled via two or more casino games such as keno or video poker games. If the outcome of the first game is winning, the player may be awarded first winnings. If the outcome of the second game is winning, the player may be awarded second winnings. Regardless of the outcomes of the base games, if designated indicia comprising certain indicia from the first and second games match a selected set of indicia, then the lottery-type game is winning. In the case of a keno game, the designated indicia may be certain player numbers from the keno games and in the case of a poker game, certain player-selected cards. The selected set of indicia may comprise drawn keno numbers or dealt cards.

13 Claims, 4 Drawing Sheets

(56) References Cited

U.S. PATENT DOCUMENTS 5,282,620 A * 2/1994 Keesee ..... A63F 3/081 463/20
5,393,057 A * 2/1995 Marnell, II ..... G07F 17/32 273/269
5,674,128 A * 10/1997 Holch et al. ..... A63F 3/081 463/18
5,797,794 A * 8/1998 Angell ..... A63F 3/081 463/17
5,909,875 A * 6/1999 Weingardt ..... A63F 3/0645 273/269
5,935,001 A * 8/1999 Baba ..... G07F 17/3244 463/18
6,024,641 A * 2/2000 Sarno ..... G07C 15/00 273/138.2
6,048,269 A * 4/2000 Burns ..... G07F 7/04 463/25
6,102,400 A * 8/2000 Scott ..... A63F 3/00157 273/138.1
6,224,484 B1 * 5/2001 Okuda ..... G07F 17/32 463/17
6,270,407 B1 * 8/2001 Dodge ..... A63F 3/0645 273/269
6,315,290 B1 * 11/2001 Roethel ..... A63F 3/0645 273/138.1
6,497,408 B1 * 12/2002 Walker ..... G07F 17/32 273/138.1
6,722,978 B2 * 4/2004 Valenti ..... A63F 3/081 273/269
7,740,243 B1 * 6/2010 Kean ..... G07F 17/329 273/139
8,512,144 B2 8/2013 Johnson et al.
8,956,211 B2 2/2015 Johnson
2001/0036855 A1 * 11/2001 DeFrees-Parrott ..... G07F 17/34 463/17
2002/0025845 A1 * 2/2002 Cannon ..... A63F 3/00157 463/16
2002/0063387 A1 * 5/2002 Timpano ..... A63F 3/06 273/274
2003/0017867 A1 * 1/2003 deKeller ..... A63F 3/0645 463/18
2003/0144048 A1 * 7/2003 Silva ..... A63F 3/00157 463/16
2004/0072608 A1 * 4/2004 Toyoda ..... G07F 17/3244 463/17
2005/0164767 A1 * 7/2005 Wright ..... G07F 17/329 463/17
2008/0004108 A1 * 1/2008 Klinkhammer ..... G07F 17/32 463/29
2008/0113802 A1 * 5/2008 Johnson ..... G07F 17/3239 463/40
2008/0167110 A1 * 7/2008 Fisk ..... A63F 3/0605 463/17
2009/0191938 A1 * 7/2009 Hill ..... G07F 17/32 463/17
2009/0209312 A1 * 8/2009 Alderucci ..... G07F 17/3244 463/17
2009/0283971 A1 * 11/2009 Martineck, Sr. ..... A63F 1/04 273/293
2010/0130284 A1 * 5/2010 Luciano, Jr. ..... G07F 17/3244 463/25
2010/0203942 A1 * 8/2010 Walker ..... G07F 17/32 463/17
2013/0072293 A1 * 3/2013 Johnson ..... A63F 9/24 463/25
2013/0237300 A1 * 9/2013 Johnson ..... G07F 17/3255 463/13
2014/0080562 A1 3/2014 Johnson
2014/0094256 A1 * 4/2014 Hilbert ..... G07F 17/3211 463/20
2014/0106840 A1 * 4/2014 Irwin, Jr. ..... G07F 17/329 463/17
2014/0256393 A1 * 9/2014 Navarrete ..... A63F 3/0645 463/17

* cited by examiner

KENO

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 37 | 39 | 40 |
| 41 | 42 | 43 | 44 | 45 | 46 | 47 | 48 | 49 | 50 |
| 51 | 52 | 53 | 53 | 54 | 55 | 56 | 57 | 58 | 59 | 60 |
| 61 | 62 | 63 | 63 | 64 | 65 | 66 | 67 | 68 | 69 | 70 |
| 71 | 72 | 73 | 73 | 74 | 75 | 76 | 77 | 78 | 79 | 80 |

PLAYER
GAME CARD 2

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 37 | 39 | 40 |
| 41 | 42 | 43 | 44 | 45 | 46 | 47 | 48 | 49 | 50 |
| 51 | 52 | 53 | 54 | ~~55~~ | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

55

PLAYER
GAME CARD 1

| | | | | | | | | | |
|---|---|---|---|---|---|---|---|---|---|
| 1 | 2 | 3 | ~~4~~ | 5 | 6 | 7 | 8 | 9 | 10 |
| 11 | 12 | 13 | 14 | 15 | ~~16~~ | 17 | 18 | 19 | 20 |
| 21 | 22 | 23 | 24 | 25 | 26 | 27 | 28 | 29 | 30 |
| 31 | 32 | 33 | 34 | 35 | 36 | 37 | ~~38~~ | 39 | 40 |
| 41 | 42 | ~~43~~ | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | ~~74~~ | 75 | 76 | 77 | 78 | 79 | 80 |

4 38 43 74 16

FIG. 1

LOTTERY-TYPE GAME BASED UPON AT LEAST TWO CASINO GAMES

RELATED APPLICATION DATA

This application is a continuation of U.S. application Ser. No. 13/932,148, filed Jul. 1, 2013, which claims priority to U.S. Provisional Application Ser. No. 61/691,001, filed Aug. 20, 2012 and U.S. Provisional Application Ser. No. 61/713,904, filed Oct. 15, 2012. The present application claims priority to each of said applications and incorporates by reference each of said applications as if set forth fully herein.

FIELD OF THE INVENTION

The present invention relates to wagering games.

BACKGROUND OF THE INVENTION

In traditional lottery games a player picks or is provided a set of player numbers from a larger set of numbers. A set of game numbers is then randomly selected from that same set of numbers. If the player's numbers match the game numbers, then the player is declared to be the winner. Generally, the size of the lottery prize is dependent upon the number of purchased tickets. One advantage to lotteries is that they often have large jackpots or awards due to the fact that winning outcomes are infrequently received.

Unfortunately, lottery games are not legal in many jurisdictions. In addition, lottery games are very simplistic and lack the excitement of many other games such as video slots. For example, once the lottery or game numbers are selected, the player determines if their numbers have matched and then game is immediately over. Unfortunately, very frequently there are no winners corresponding to a particular set of selected lottery or game numbers. At that point, the player has to again purchase one or more lottery tickets with player numbers relative to the next lottery number selection which may be days or a week away.

SUMMARY OF THE INVENTION

Aspects of the invention comprise methods of playing and presenting games and gaming systems. In one embodiment of the invention, a lottery-type game is enabled via two or more casino-style wagering games such as games of video poker or keno.

One embodiment of the invention comprises a method of presenting a lottery-type casino-game based game to a player of a gaming machine or device. The method comprises the steps of: (a) receiving at least one wager from the player; (b) presenting a first casino-style wagering game comprising displaying at least a first set of indicia to the player via a display of the gaming device; (c) if an outcome of the first casino-style wagering game is a winning outcome, awarding first winnings to the player; (d) presenting a second casino-style wagering game comprising displaying at least a second set of indicia to the player via the display of the gaming device; (e) if an outcome of the second casino-style wagering game is a winning outcome, awarding second winnings to the player; (f) regardless of whether the outcomes of the first and/or second casino-style wagering games are winning or losing, determining if designated indicia comprising at least one indicia from the first set of indicia and at least one indicia from the second indicia match a selected set of indicia; and (g) if so, declaring a winning outcome of the lottery-type game.

In one embodiment of the invention, the first and second casino-style wagering games comprise first and second keno games. In one configuration of such an implementation, a player selects at least one player number for play relative to one of the keno games and at least two player numbers for play relative to another of the keno games, the combined set of numbers comprising the player's "lottery" numbers. Each keno game is independently presented and the outcomes of those games are determined. If all of the player's numbers are matched in the play of both of the keno games, preferably with the game numbers and player numbers in each game matching in sequence, the player is awarded a lottery-type award. Such an award may be a progressive jackpot.

In another embodiment of the invention, the first and second casino-style wagering games comprise first and second poker games. In one configuration of such an implementation, a player selects at least one card relative to the play of one of the video poker games and at least two cards relative to the play of the other video poker game. The player then plays each video poker game. If the player achieves a winning hand in either individual video poker game, then the player may be awarded winnings for the winning outcome (s). In addition, if the player's selected cards are matched by the cards which are dealt to the player in the play of the two video poker games, preferably in the exact same sequence, the player is awarded a lottery-type award.

Further objects, features, and advantages of the present invention over the prior art will become apparent from the detailed description of the drawings which follows, when considered with the attached figures.

DESCRIPTION OF THE DRAWINGS

FIG. 1 illustrates a keno game board and player game cards in accordance with a game of the invention;

DETAILED DESCRIPTION OF THE INVENTION

Figure 2:
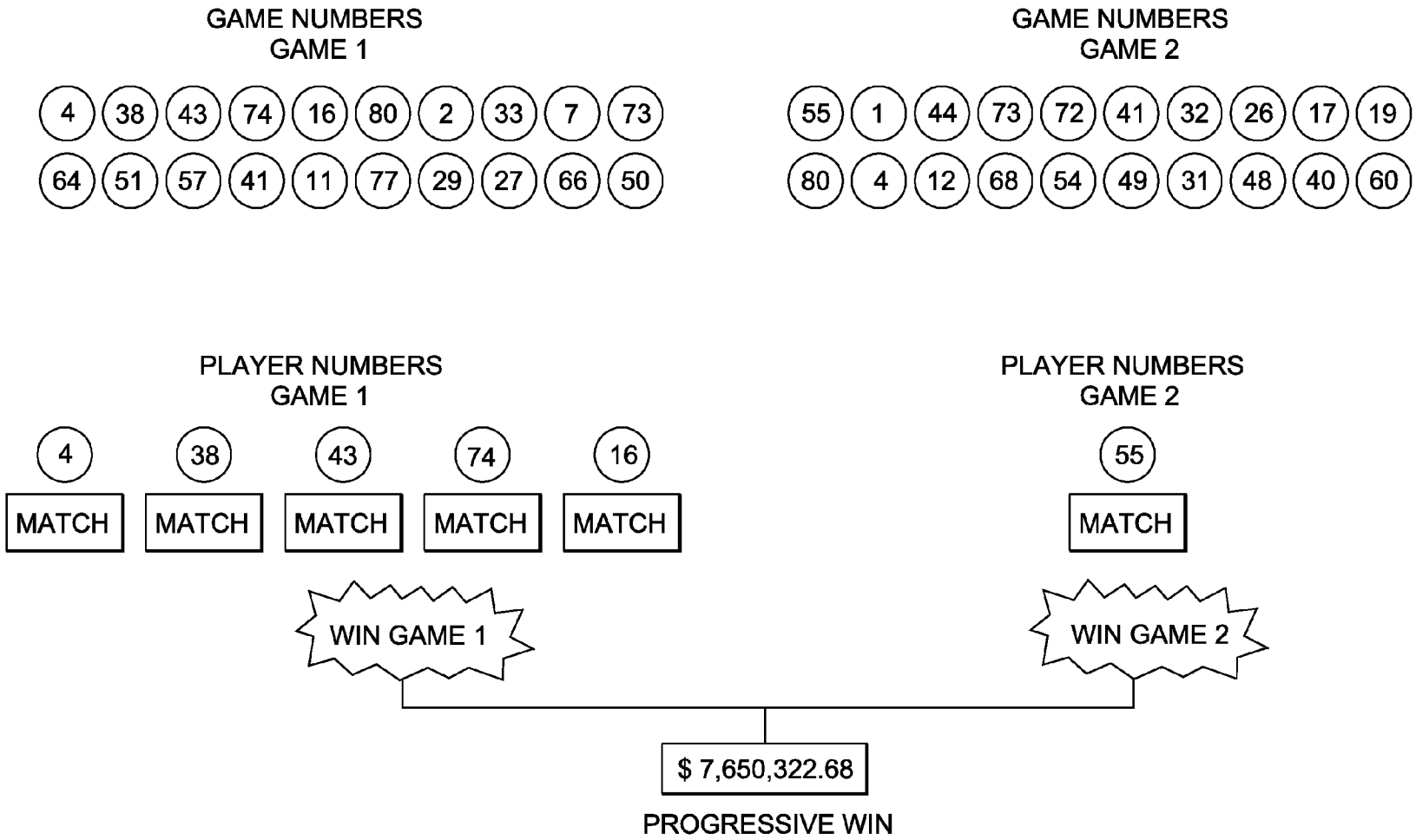
FIG. 2 illustrates selected game numbers and corresponding player numbers for two games of keno in accordance with a game of the invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a casino game based lottery-type game. In general, a lottery-type game is enabled via play of two or more casino games such as games of keno, video poker or the like.

One embodiment of the invention comprises a method of presenting a lottery-type casino-game based game to a player of a gaming machine or device. The method comprises the steps of: (a) receiving at least one wager from the player; (b) presenting a first casino-style wagering game comprising displaying at least a first set of indicia to the player via a display of the gaming device; (c) if an outcome of the first casino-style wagering game is a winning outcome, awarding first winnings to the player; (d) presenting a second casino-style wagering game comprising displaying at least a second set of indicia to the player via the display of the gaming device; (e) if an outcome of the second casino-style wagering game is a winning outcome, awarding second winnings to the player; (f) regardless of whether the outcomes of the first and/or second casino-style wagering games are winning or losing, determining if designated indicia comprising at least one indicia from the first set of indicia and at least one indicia from the second indicia match a selected set of indicia; and (g) if so, declaring a winning outcome of the lottery-type game.

For example, in one embodiment the lottery-type game is enabled via two or more keno games. In one implementation, a player selects at least one player number for play relative to one of the keno games and at least two player numbers for play relative to another of the keno games, the combined set of numbers comprising the player's "lottery" numbers. Each keno game is independently presented and the outcomes of those games are determined. If all of the player's numbers are matched in the play of both of the keno games, preferably with the game numbers and player numbers in each game matching in sequence, the player is awarded a lottery-type award. Such an award may be a progressive jackpot.

In another embodiment, the lottery-type game is enabled via two or more poker games, such as video poker games. In one implementation, a player selects at least one card relative to the play of one of the video poker games and at least two cards relative to the play of the other video poker game. The player then plays each video poker game. If the player achieves a winning hand in either individual video poker game, then the player may be awarded winnings for the winning outcome(s). In addition, if the player's selected cards are matched by the cards which are dealt to the player in the play of the two video poker games, preferably in the exact same sequence, the player is awarded a lottery-type award.

In accordance with the invention, in a first step of playing and presenting a game of the invention, a player places a wager. The player may place the wager with a game operator or "house", such as a casino or the like. As described below, such a wager might be placed at a cashier window, ticket booth, gaming machine or the like, depending upon the gaming environment. The wager might be placed in monetary funds or in credits which represent monetary funds, points or the like.

Keno Based Lottery-Type Game

As described in more detail below, one aspect of the invention is a lottery-type game which is presented in association with first and second keno games. Because the lottery-type game is presented in association with individual keno games, in a preferred embodiment one or more players may also play either or both of the keno games, such as in accordance with traditional keno game rules. Thus, a player might be permitted to place a wager to play just one keno game (to play only the first or second keno game), place a wager to play both the first and second keno games, place a wager to play to play both the first and second keno games and the lottery-type game, or place a wager to play just the lottery-type game. Of course, the amounts or values of the various wagers may vary. For example, a player might be required to place a minimum $1 wager to play either keno game, and thus $2 to play both keno games, and in addition be required to place a $1 wager to participate in the lottery-type game. In other embodiments, a player might be permitted to place wagers of varying amounts to play the keno games but might be permitted to place a single wager to simply play the lottery-type game.

If the player elects to play the lottery-type game, the player then selects player numbers corresponding to a first keno game and a second keno game. In one embodiment, the player is preferably required to select at least 2 player numbers corresponding to one of the games and at least 1 player number corresponding to the other game. In a most preferred embodiment, the player is required to select 5 player numbers corresponding to the first keno game and 1 player number corresponding to the second keno game.

As illustrated in FIG. 1, in a preferred embodiment the underlying keno games are presented in traditional keno game format where the game is played using the 80 numbers numbered 1-80. FIG. 1 illustrates a game board which displays the numbers which are used in the game.

FIG. 1 also illustrates an example of the invention wherein a player has elected to play the lottery-type game and has thus selected player numbers corresponding to first and second games of keno. As illustrated, a player may be provided a printed keno game card or such a card may be displayed to the player, such as at an electronic gaming machine.

In the embodiment illustrated, the player has selected player numbers 4, 38, 43, 74, and 16 corresponding to the first keno game and player number 55 corresponding to the second keno game.

After all players have made their player number selections, such as may be required within a specified time frame, game numbers are preferably selected for each of the first and second games of keno. As illustrated in FIG. 2, a first set of game numbers is selected relative to the first keno game. Such a selection may comprise the random selection of numbers (such as using a random number generator), random selection of numbered balls or the like. For the reasons described below, the game numbers are preferably selected in or designated to have a particular sequence.

In a preferred embodiment, 20 game numbers are randomly selected from the set of 80 numbers. In the example illustrated in FIG. 2, the game numbers 4, 38, 43, 74, 16, 80, 2, 3, 7, 73, 64, 51, 57, 41, 11, 77, 29, 27, 66, and 50 have been selected, having that particular sequence.

Likewise, as illustrated in FIG. 2, a second set of game numbers is selected relative to the second keno game. In the example illustrated in FIG. 2, the game numbers 55, 1, 44, 73, 72, 41, 32, 26, 17, 19, 80, 4, 12, 68, 54, 49, 31, 48, 40 and 60 have been selected, having that particular sequence.

In accordance with an embodiment of the invention, the player is a winner of the lottery-type game if certain of the player's selected numbers for both keno games are matched by the game numbers for those respective two keno games. In one embodiment, at least one of the player's numbers from one of the games and at least two of the player's numbers from the other game are used in the play of the lottery-type game. In a most preferred embodiment of the invention, the player's numbers must be matched in sequence with the selected game numbers for each game. Thus, as one aspect of the invention, when a player selects their numbers, the player's selections are preferably designated in a sequence or order (such as 4, 38, 43, 74 and then 16 in the example illustrated in FIG. 1 relative to the first keno game card). In addition, the game numbers are drawn or selected in a particular sequence. If the player's numbers are matched in sequence to the game numbers (or on a position-by-position basis), then the player is declared to be a winner of the lottery-type game.

As one example, referring to FIG. 2, relative to the first keno game, the player number in the first position, 4, is matched by the game number in the first position, 4. Likewise, the second player number 38 is matched by the second game number 38, and so on. Likewise, in the second keno game the single player number 55 was matched by the first selected game number 55. In this condition, the player has achieved a winning outcome of the lottery-type game.

In one embodiment, if a winning outcome of the lottery-type game is declared then the winning player or players is/are awarded winnings. Such winnings may be prizes, coupons, discounts, goods or services, points, credits, monies or the like. For example, the winnings may be monetary value credits. Because the probabilities of winning the lottery-type event may be relatively low, the winnings may be a large award, such as a jackpot. In one embodiment, the jackpot may be a pre-set large winning amount (preferably larger than the largest award for a win of an individual keno game). In a preferred embodiment, the jackpot is a progressive jackpot which is funded from at least a portion of wagers on the keno games and which thus grows over time. For example, players may be required to place a first wager amount to play the first and second keno games and a side wager to participate in the bonus feature. All or a part of each side wager may be used to fund the progressive jackpot. Alternatively, a player may place a single wager to play the entire game and a portion of that wager may be used to fund the progressive jackpot. In the example illustrated, the player has won a progressive jackpot having a value of $7,650,322.68. In a preferred embodiment, the lottery-type award is a fixed amount which does not depend upon the number of players/wagers, though the award might be increased from one fixed amount to another at various intervals of time or play if a lottery-type win does not occur. For example, the award might start at $10,000.000 and increase by $1,000,000 each week that the lottery-type win is not achieved.

If two or more players achieve a lottery game winning outcome, they may split the jackpot. For example, if three players are declared to be winners of the lottery-type game, they may split the jackpot 3 ways.

Various additional aspects of the invention will now be appreciated. As one aspect of the invention, the lottery-type game is based upon at least two keno games. Thus, in addition to the lottery-type game, one or more players may play the individual keno games.

For example, a first player might play a 10 or 20 number game (wherein the player selects 10 or 20 player numbers) in the first game of keno (but not play the second game of keno and not play the jackpot or lottery feature). A second player might similarly play a 10 or 20 number game in the second game of keno (but not play the first game of keno and not play the jackpot or lottery feature). A third player might play a 10 or 20 number game in both the first and second keno games (but not play the jackpot or lottery feature). A fourth player might play the lottery-type game wherein they select the designated number of player numbers in the first game (such as 5 player numbers) and the designated number of player numbers in the second game (such as 1 player number). Thus, in this fashion, players can play traditional keno games or they can play the lottery-type keno-based game.

It is also possible for a player who is playing the lottery-type game to play the individual keno games. For example, in one configuration, if a player who is playing the lottery-type game has a specific number of matches of their player numbers to the selected game numbers for a particular keno game, then the player may be declared to be a winner and may be awarded winnings for that particular keno game.

For example, in the example illustrated in FIG. 2, the player has matched all 5 of their player numbers to selected game numbers in the first keno game. As such, the player may be awarded an award for a winning outcome of the first keno game, such as a monetary award or an award of credits or points. In addition, the player has matched their single player number to the selected game numbers in the second keno game. As such, the player may be awarded an award for a winning outcome of the second keno game.

In such a configuration, the player could lose the lottery game and still win the first and/or second keno game. For example, assume that in the first keno game the selected game numbers were 16, 4, 38, 43 and 74. In that event, all of the player numbers for the first keno game would have been matched by a selected game number, just not in the same order. In that event, the player might be awarded an award for the keno game but would not be a winner of the lottery-type game.

As indicated above, in a preferred embodiment of the invention the lottery-type game is played with 5 player numbers corresponding to a first keno game and 1 player number corresponding to a second keno game. However, as indicated, the game may be played in other fashions, preferably where at least two player numbers are used in one of the keno games and at least one player number is used in another of the keno games. For example, the game could be played with 7 player numbers corresponding to a first keno game and 2 player numbers corresponding to a second keno game or 1 player number corresponding to a first keno game and 4 numbers corresponding to a second keno game. Also, the lottery-type game could be implemented via more than two keno games (such as 3 player numbers corresponding to a first keno game, 2 player numbers corresponding to a second keno game and 1 player number corresponding to a third player game).

While the lottery-type game is played using specified numbers of player numbers in two or more keno games, the player might be permitted to select additional player numbers for each game relative to the play of an underlying keno game. For example, a player might select 20 player numbers relative to the first keno game and 20 numbers relative to the second keno game. The outcome of the lottery-type game may be determined relative to the first 5 player number for the first game and the first player number for the second game, while the outcome of the first and second keno games may be determined relative to all 20 of the player's numbers for those games.

While the player numbers have been described as being selected by a player, the player could elect to have one or more of the numbers randomly selected or assigned. For example, a player might simply purchase a ticket having randomly assigned player numbers for the first and second games. Those numbers are then used in the play of the game.

It will be appreciated that in the case of a progressive jackpot, the jackpot may be awarded as soon as any player achieves a lottery game win. Thus, keno games may be presented in a frequent interval, such as many times per day. Players may play the lottery type game relative to two or more of the keno games presented at any time of the day. Players might also be permitted to play the lottery game relative to two keno games which are not presented in succession.

In other embodiments of the invention, other winning results and associated awards could be defined. For example, lesser winning outcomes and awards might be defined for matching some, but not all, of the numbers. For example, a base lottery win might be declared if a player matched 4 of 6 of their selected numbers (and have an associated base award), and a larger lottery win might be declared if a player matched 5 of 6 of their selected numbers (and have an associated higher award). Other winning results might be declared, for example, if the player matched the single player number in the second game, or all 5 numbers in the first game (but not the $6^{th}$ number in the second game). Of course, other winning combinations might be declared.

Poker Based Lottery-Type Game

Another aspect of the invention is a lottery-type game which is presented in association with first and second video poker games. Because the lottery-type game is presented in association with individual video poker games, in a preferred embodiment one or more players may also play either or both of the video poker games, such as in accordance with traditional video poker game rules. Thus, a player might be permitted to place a wager to play just one video poker game (to play only the first or second video poker game), place a wager to play both the first and second video poker games, place a wager to play to play both the first and second video poker games and the lottery-type game, or place a wager to play just the lottery-type game. Of course, the amounts or values of the various wagers may vary. For example, a player might be required to place a minimum $1 wager to play either video game, and thus $2 to play both video poker games, and in additional be required to place a $1 wager to participate in the lottery-type game. In other embodiments, a player might be permitted to place wagers of varying amounts to play the video poker games but might be permitted to place a single wager to simply play the lottery-type game.

If the player elects to play the lottery-type game, the player then selects one or more cards corresponding to a first video poker game and a second video poker game. In one embodiment, the player is preferably required to select at least 2 cards corresponding to one of the games and at least 1 card corresponding to the other game. In a most preferred embodiment, the player is required select 5 cards corresponding to the first video poker game and 1 card corresponding to the second video poker game.

Figure 3:
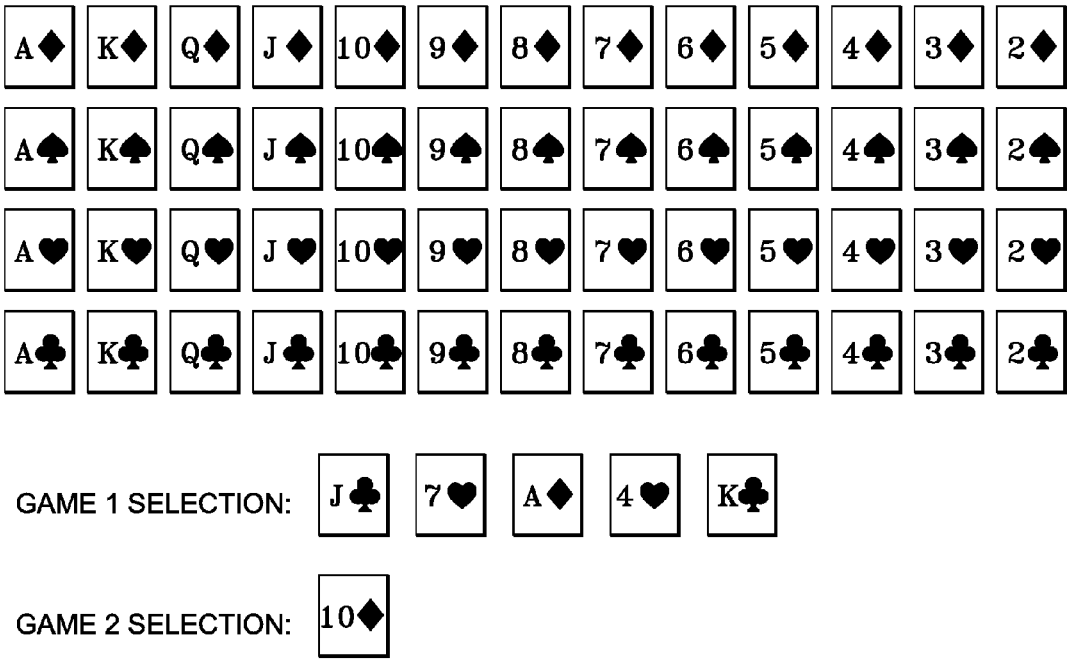
FIG. 3 illustrates set of cards from which a player selects cards for a video-poker based game of the invention.

As illustrated in FIG. 3, in a preferred embodiment the underlying video poker games are presented in traditional format using one or more standard 52 card decks (13 cards of A, K, Q, J, 10, 9, 8, 7, 6, 5, 4, 3, and 2, in each of the suits of Hearts, Diamonds, Clubs and Spades). Of course, other decks of cards (such as including bonus or wild cards, etc.) might be used.

In one embodiment a player may select cards from one or more sets of displayed cards or from numbers which represent the cards. For example, a player may be displayed images corresponding to the cards in two decks of cards. The player may then select one or more cards from each set of displayed cards, which selections correspond to two different poker games. Alternatively, the player might select numbers. For example, coding of numbers to cards may be utilized (e.g. 1=Ace of Spaces, 2=Ace of Diamonds, 3=Ace of Hearts, 4=Ace of Clubs . . . 52=2 of Clubs).

FIG. 3 illustrates an example of the invention wherein a player has elected to play the lottery-type game and has thus selected cards corresponding to first and second video poker games.

In the embodiment illustrated, the player has selected the cards J♣, 7♥, A♦, 4♥ and K♣ corresponding to the first video poker game and the 10♦ corresponding to the second video poker game.

Once the player has made their card selections, first and second games of video poker are presented to the player. In one embodiment, the first video poker game begins by dealing a hand of 5 cards to the player. If the video poker game is presented as a "draw" type game, the player may be permitted to discard one or more cards and be dealt a replacement card for each discarded card. The outcome of the first game of video poker may be determined by a player's final hand of cards, such as by comparing that hand of cards to a pay table of winning outcomes. Such winning outcomes may comprise standard winning poker hands such as a pair, two pair, three of a kind, a full house, four of a kind, a straight, a flush or a royal flush. Of course, other winnings hands might be designated. Preferably, each winning hand has an associated award, such as an award of money or monetary value credits.

Likewise, the player is preferably presented a second game of video poker. This game is played independent of the first game, i.e. a new hand of 5 cards is dealt to the player and then the player plays that hand to completion. Again, the player may have the opportunity for winnings based upon the outcome of the second video poker game.

Most importantly, in accordance with an embodiment of the invention, the player is a winner of the lottery-type game if all of the player's selected cards for both video poker games are matched by the cards which are dealt in those respective two video poker games. In a most preferred embodiment of the invention, the player's selected cards must be matched in sequence with the cards which are dealt to the player for each game. Thus, as one aspect of the invention, when a player selects their cards, the player's cards are preferably designated in a sequence or order (such as J♣, 7♥, A♦, 4♥, and then K♣ in the example illustrated in FIG. 3 relative to the first game of video poker). In addition, the cards used in each video poker game dealt in a particular sequence. If the player's selected cards are matched in sequence to the dealt cards (or on a position-by-position basis), then the player is declared to be a winner of the lottery-type game.

Figure 4:
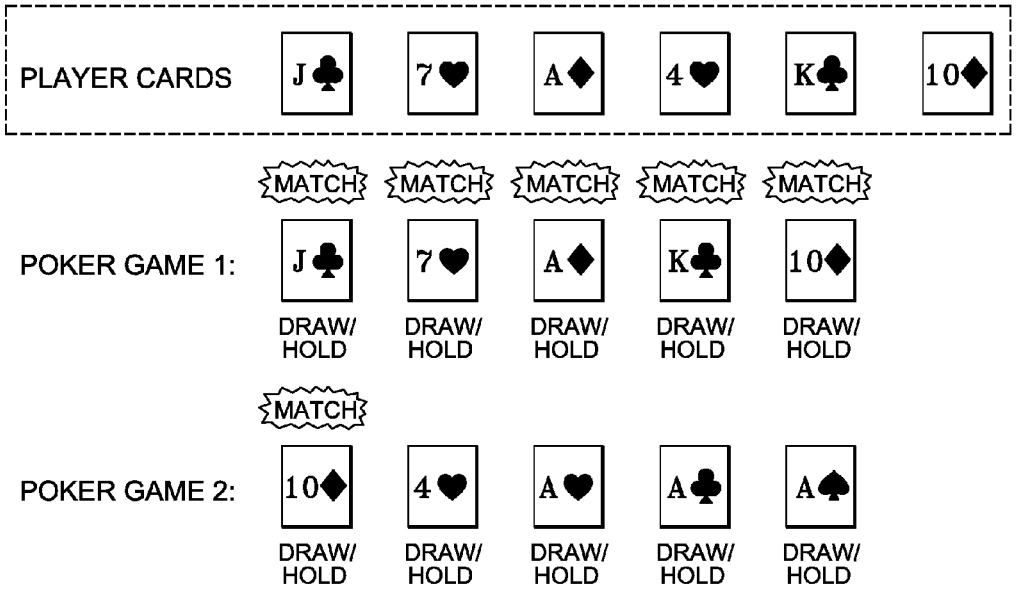
FIG. 4 illustrates cards dealt to a player as part of first and second video poker games in accordance with an example of the invention.

As one example, referring to FIG. 4, relative to the first video poker game, the player card in the first position, J♣, is matched by the first card which is dealt to the player in the first video poker game (the J♣). Likewise, the second player card 7♥ is matched by the second dealt card, and so on. Likewise, in the second video poker game the single player card 10♦ was matched by the first dealt card, the 10♦. In this condition, the player has achieved a winning outcome of the lottery-type game.

As with the previous embodiment, if a winning outcome of the lottery-type game is declared then the winning player or players is/are awarded winnings. As described above, such winnings may be in the form of a jackpot or have various other forms. In addition, if two or more players achieve a lottery game winning outcome, they may split the jackpot. For example, if three players are declared to be winners of the lottery-type game, they may split the jackpot 3 ways. Also, it will again be appreciated that one aspect of the invention is that the player can win the lottery-type game without winning either or both of the base poker games (i.e. a winning wager on the base games is not required in order for the player to win the lottery-type game).

As with the previous embodiment, the poker-based version of the lottery-type game may be implemented in various fashions. For example, the lottery-type game may be based upon more than two video poker games. For example, a player might select a single card relative to each of five different video poker games.

As indicated above, the player's card selections might be represented as numbers. The cards used in the video poker games might also be represented as numbers such that the outcome of the lottery-type game comprises matching of the numbers which represent the cards.

The invention has a number of advantages. A most important aspect of the invention is that the jackpot or lottery feature of the game is derived specifically from two or more casino games. Thus, the jackpot or lottery game or feature does not have to be generated by presentation of an entirely new or different game. Instead, the jackpot or lottery game can be implemented via existing casino games and gaming systems. Another advantage to the game is that a player can play both a casino game and lottery type games at the same time, adding to the excitement of game play and also adding to the player's chances of obtaining a winning outcome.

Figure 5:
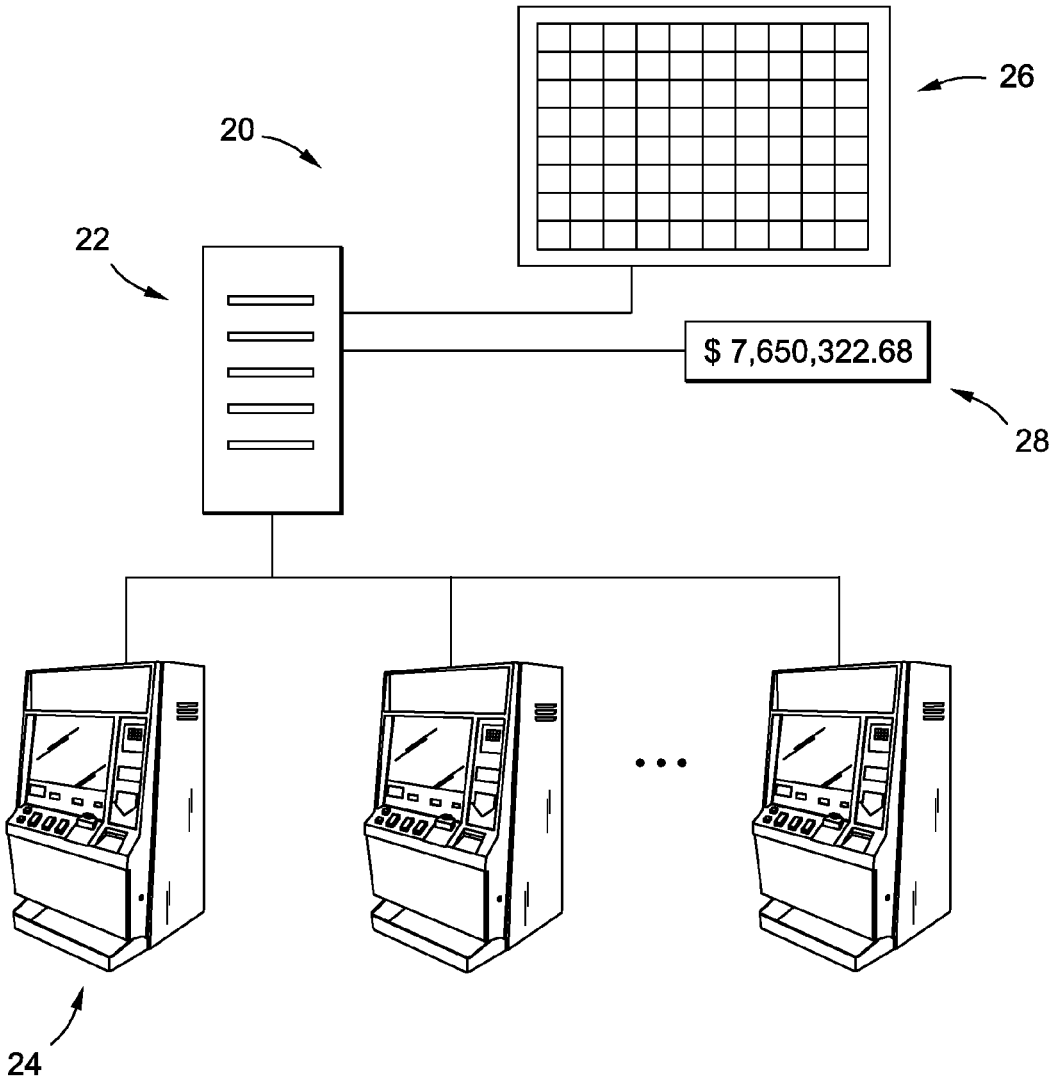
FIG. 5 illustrates an exemplary gaming system in accordance with an embodiment of the invention.

As indicated above, the invention can be implemented in various forms, including in various environments. FIG. 5 illustrates one example of a gaming system 20 via which the invention may be presented. As illustrated, a keno game server 22 is configured to generate game data and track game results. A player may place a wager at a gaming machine or kiosk 24. Upon placing a wager, the gaming machine 24 may be configured to display game options and receive a player's selection of player numbers. Such an input may be via buttons, a touch screen or the like. The player numbers may be shown relative to an electronically represented keno game card. The player's selected numbers are stored for use in determining the outcome of the game.

The game server 22 may randomly select game numbers for each keno game, such as by using a random number generator. Alternatively, the numbers might be selected to a keno ball blower or other means. In one embodiment, selected game numbers may be highlighted on an electronic game board 26 and/or upon a display at the gaming machine 24.

After the game numbers for the keno games have been determined, those numbers are compared to the player's numbers for purposes of determining the outcomes of the keno games and the lottery-type game of the invention. If the requisite outcomes are achieved, the player may be awarded winnings. As indicated, such may comprise an award of credits to the player at the gaming machine 24, an award of coins, currency or other prizes. As illustrated, the game system 20 may include one or more award displays 28 for displaying the current value of the jackpot for the lottery-type game.

It will be appreciated that in this configuration, the ball draws for the individual keno games are used to play the lottery game of the invention. In particular, the balls (or numbers) which are selected for use in determining the outcome of individual video keno games are preferably used in the player of the lottery game.

Of course, the game might be presented in other fashions. For example, players might be permitted to select player numbers via printed keno tickets. Those tickets may be compared to selected game numbers (such as by scanning the player's ticket and providing the scanned information to the server 22 for verification) for determining the outcome of the keno and/or lottery games.

A similar gaming system 20 may be used to present the poker game variation of the invention. In such a configuration, one or more of the gaming machines 24 may be configured to present video poker games. The game server 22 may be configured to track games played, including player card selections and video poker game data, such as for verifying a lottery-type game wins.

The gaming machines or devices which may be used to present the invention may have various configurations. In one embodiment, the gaming machine 24 may comprise a typical casino-style gaming machine which comprises a housing or cabinet for supporting and/or enclosing various components required for operation of the gaming machine. In one embodiment, the housing includes a door located at a front thereof, the door capable of being moved between an open position which allows access to the interior, and a closed position in which access to the interior is generally prevented. The gaming machine 24 may have an "upright" configuration. However, the gaming machine 24 could have other configurations, shapes or dimensions (such as being of a "slant"-type, "bar-top" or other configuration as is well known to those of skill in the art).

The gaming machine 24 preferably includes at least one display device configured to display game information. The display device may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display may be capable of projecting or displaying a wide variety of information, including images, symbols and other indicia or information associated with game play, game promotion or other events.

As described herein in more detail, the gaming machine 24 is preferably configured to present one or more games upon a player making a monetary payment or wager. In this regard, as described in more detail below, the gaming machine 24 includes means for accepting monetary value.

As also detailed herein, certain game outcomes may be designated as winning outcomes. Prizes or awards may be provided for winning outcomes, such as monetary payments (or representations thereof, such as prize of credits), or promotional awards as detailed herein. As detailed below, the gaming machine 24 includes means for returning unused monetary funds and/or dispensing winnings to a player.

The gaming machine 24 preferably includes one or more player input devices (such as input buttons, plunger mechanisms, a touch-screen display, joystick, touch-pad or the like). These one or more devices may be utilized by the player to facilitate game play, such as by providing input or instruction to the gaming machine 24. For example, such input devices may be utilized by a player to place a wager, cause the gaming machine 24 to initiate a game, to indicate cards to be held or discarded, to "cash out" of the gaming machine, or to provide various other inputs.

In one preferred embodiment, the gaming machine 24 includes at least one microprocessor or controller for controlling the gaming machine, including receiving player input and sending output signals for controlling the various components of the machine 24 (such as generating game information for display by the display). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display (such as information representing images of displayed cards), for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 24 may also include one or more random number generators for generating random numbers, such as for use in selecting cards and for presenting the game in a random fashion.

Preferably, the controller is configured to execute machine readable code or instructions which are configured to implement the method of game play of the invention. For example, the controller of the gaming machine 24 may be configured to detect a wager, such as a signal from a player's depressing of the "bet one" button. Upon such an event and/or the player otherwise signaling the gaming machine to present the game, the controller may be configured to cause images of slot symbols, keno number, playing cards or the like to be displayed on the at least one display relative to the one or more base casino-style game. As used herein, the term "base" is meant primarily to connote a game which serves as a basis for the over-riding lottery-type game and is not meant to imply that the game might not comprise a bonus event of a casino game or other type of game. For example, a casino game might have a primary game portion and a bonus portion. The lottery-type game might be implemented relative to the bonus portion of each of two games (rather than the base or primary portion of those games). The controller may accept input from a player, such as of cards to discard and draw or the like, via the one or more player input devices of the gaming machine 24.

The gaming machine 24 may be configured to generate and present games in a stand-alone manner or it may be in communication with one or more external devices at one or more times. For example, the gaming machine 24 may be configured as a server based device and obtain game code or game outcome information from a remote game server (in which event the gaming machine controller may receive game information from the server, such as game outcome information, and use that server-generated information to present the game at the gaming machine—i.e. the gaming machine may be configured to operate with its own RNG or one which is server-based/generated).

As indicated, the gaming machine 24 is configured to present one or more wagering games. Thus, the gaming machine 24 is preferably configured to accept value, such as in the form of coins, tokens, paper currency or other elements or devices representing value such as monetary funds. For example, the gaming machine 24 might include a coin acceptor for accepting coins. Of course, associated coin reading/verifying devices and coin storage devices may be associated with the gaming machine 24 if it is configured to accept coins. Likewise, the gaming machine 24 might include a media reader. Such a reader may be configured to accept and read/verify paper currency and/or other media such as tickets. Of course, in such event the gaming machine 24 may further be configured with one or more paper currency or ticket storage devices, such as cash boxes, and other paper currency or media handling devices (including transport devices). Of course, the gaming machine 24 might also be configured to allow a player to wager funds on account or electronic funds/credits.

The gaming machine 24 might also be configured to read FOBs, magnetic stripe cards or other media having data associated therewith and via which value or funds may be associated with the gaming machine 24.

In one embodiment, the gaming machine 24 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 24 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 24 may also include a player tracking device, such as a card reader and associated keypad. Such player tracking devices are well known and may permit the game operator to track play of players of the gaming machine. The tracked play may be utilized to offer player bonuses or awards.

In another embodiment, the gaming machine 24 may include one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference. For example, the base symbols might be associated with spinning reels. Sets of base symbols might be generated by spinning those reels.

In one embodiment, the lottery-type game might be implemented at an existing gaming machine 24, such as by using a secondary controller described in U.S. application Ser. No. 11/897,532, filed Aug. 30, 2007, which is incorporated herein in its entirety by reference. In such a configuration, if the base gaming machine is a keno gaming machine, the secondary controller may simply be used to accept a player's selection of numbers for the lottery-type game and then compare those numbers to those which were generated by the keno gaming machine for use in base keno games. However, if the base gaming machine is not configured to present a base keno game (such as in the case of a video poker machine or the like), the secondary controller may be configured to accept a player's selection of player numbers, select keno balls/numbers and determine matches thereof, and thus present base keno games and the lottery-type game of the invention.

If the gaming machine is a video poker gaming machine, the secondary controller may simply be used to accept a player's selection of cards for the lottery-type game and then compare those cards to those which were generated by the gaming machine as part of the presentation of the video poker games. For example, in such a configuration, the secondary controller may be configured to receive a side lottery game wager and then display cards to a player for selection relative to the first and second games. The gaming machine may then present the first and second video poker games, with the secondary controller tracking the cards which are generated by the gaming machine and displayed/dealt to the player. The gaming machine thus determines wins of the individual video poker games, while the secondary controller determines if the lottery-type game was won.

Via use of a secondary controller as described above, an existing gaming machine or system may be modified to present the additional lottery-game functionality.

The invention can also be implemented in an on-line environment. For example, the gaming machine or device might comprise a home or work computer or a mobile communication device (tablet, PDA, phone, etc.) which a player utilizes to communicate with a server or other computing device. As one example, a player might utilize a personal electronic device to access a remote game server, such as via the Internet (using one or more wired and/or wireless communication links). In such a configuration, a player might place a wager using a credit card or credits. The server may be configured to generate game information and cause the player's personal electronic device to display game information (such as game indicia regarding the base casino-style games) on a display of the player's electronic device. Winnings might be awarded in various forms, including credits.

As also indicated herein, the invention could be implemented relative to table games.

While specific examples of the lottery-type game have been described relative to underlying or associated keno or video poker games, the game could be implemented via other variations of these games or entirely different casino games. For example, the lottery-type game could be implemented relative to stud poker games (rather than draw poker games), and community poker games. Additional examples include Texas Hold'em, Omaha and other poker games. The lottery-type game may be presented relative to games known as Class II games (such as bingo and keno) and/or Class III games (such as slot games and/or video poker). In the case of games which have an underlying result and may be represented by entertaining displays (such as Class II bingo games where a base bingo outcome is shown as another outcome, such as an entertaining slot event), the lottery-type game may be presented relative to the results/indicia of the base or underlying result and/or the entertaining display.

In addition, the lottery-type game might be implemented via casino-style games other than poker and keno games, such as video slot games, bingo or other games. It is also possible to implement the lottery-type game via casino table game such as poker. For example, automated casino table games are known or conventional tables may be modified to include card or dice readers or the like. In such a manner, the results of games presented or played at tables may be determined, such as by monitoring the activities at the table, whereby the results of the lottery-type game may be determined. For example, a casino poker table might be modified to include card-reading apparatus and player displays and keypads associated with a game system. Via the keypads, the player might place lottery-type game wagers. The game system may then monitor the table game results, such as using the card-reading apparatus, to use the table game activities in determining the outcome of the lottery-type game.

As indicated herein, as one aspect of the lottery-type game, designated indicia from the at least one first and second game are compared to a selected set of indicia. As indicated, in the case of a keno game, the designated indicia might comprise the first five keno numbers selected by a player relative to a first keno game and the first keno number selected by the player related to a second keno game and the selected set of indicia may comprise the first five randomly selected keno numbers (selected by the house/casino) in the first keno game and the first randomly selected keno number in the second keno game. In the case of a poker game, the designated indicia might comprise playing cards selected by the player and the selected set of indicia may comprise certain cards dealt or displayed to the player relative to the first and second poker games.

Of course, the designated and selected indicia might vary. For example, in other variations of poker, the selected indicia might comprise the cards comprising the flop, the turn and/or the river. In the case of a draw poker game, the selected indicia could be one or more of the initially dealt cards or the one or more drawn cards.

It will be appreciated that the designated indicia might be designated in various manners. For example, a player might designate the indicia or the indicia might be designated for the player (such as automatically). For example, a player might press a button and have a set of slot symbols selected for them. The player might then play two slot games and attempt to match certain of the symbols from each game to the earlier designated symbols.

In one embodiment, the base games might comprise social-media type games where social media credits are wagered by a player. In one configuration, a third party might present the lottery-type game relative to base games which are offered by other entities. For example, a third party might offer the lottery-type game relative to base social media games offered at one or more websites. The third party might monitor the game play of the base games in order to determine the outcome of the lottery-type game. In this regard, it is noted that the term "casino-style" game may comprise a traditional casino game played at a casino gaming machine or table, or other types of games including on-line casino games and on-line social media related games, such as where the game requires a wager of points, credits or the like in order to participate in the game.

The particular implementation of the game of the invention may depend on various factors, including the environment of the implementation. For example, as indicated above, a player may be required to place a wager to play the game. The wager might only be required relative to one of the casino games or relative to both casino games, but not the lottery-type game (for example, the lottery-type game might be offered at no additional charge/wager, such as on a promotional basis). In some instances, different types of wagers might be required to be placed or might be placed for the different games. For example, in one embodiment a player might provide funds to a gaming machine and use primary monetary credits which are associated with the gaming machine to place wagers to play the casino games. The lottery-type event might be implemented via a secondary controller which is associated with the gaming machine as indicated above. A player might use secondary monetary credits, points or the like which are associated with the secondary controller/system in placing wagers to play the lottery-type event. In such a configuration, wins of the casino games might result an award of primary credits, thus increasing the total number of primary credits at the gaming machine. A win of the lottery-type event might result in an award of secondary credits or points which may be tracked separately, such as via the secondary controller.

It will also be appreciated that the manner by which a player initiates the casino games and/or the lottery-type event may vary. For example, in one embodiment, a player might utilize an on-screen menu at the gaming machine to select the lottery-type game. In another embodiment, a player might utilize a wager or bet button of the gaming machine in order to place wagers to play the casino games and might press a separate button, keypad or other input (which might be part of the gaming machine or associated therewith, such as added thereto) in order to activate the lottery-type game. In yet another embodiment, even when the lottery-type game is presented via secondary controller as described above, the lottery-type game and the casino games may be played by the player via a single input, such as in the manner described in co-pending U.S. application Ser. No. 13/622,150, filed Oct. 24, 2012, which is incorporated herein by reference in its entirety.

In addition, while the lottery-type game might be implemented relative to two or more casino games which are presented by a gaming machine as part of the basic configuration of the gaming machine, the lottery-type game might be implemented relative to other games. For example, the lottery-type game might be implemented relative to a first casino game which is implemented via a main game controller of a gaming machine and a second casino game which is implemented via a secondary controller which is associated with the gaming machine, as described in more detail above. In this regard, the two or more casino games which the lottery-type game pertains to do not have to be the same or presented in the same manner or via the same device (as indicated above, one or more of the games might even comprise on-line games, such as social media games). It is even possible for the different casino games to be associated with entirely different devices, systems or platforms. For example, the player could play the lottery-type game relative to a first casino game which is played at a first casino gaming machine and relative to a second on-line casino game which the player plays via a computing device. The results of these games may be submitted or monitored relative to a determining if the player has won or lost the lottery-type game.

Similarly, the first and second base games might be played or presented at different times. For example, the lottery-type game might be played relative to a first base game which is presented or played on Saturday and relative to a second base game which is presented or played on Sunday. The first and second base games might be separated by one or more intervening games (i.e. the first and second games do not need to be in sequence or be presented at the same gaming machine, etc.). As additional examples, a player might elect to play the lottery-type game relative to spins 1000 and 1025 on a video slot gaming machine (i.e. played relative to two games which are spaced apart by 24 intervening games). A player might elect to play the lottery-type game relative to a first keno lounge game presented at 7 p.m. on Saturday and a second keno lounge game presented at 8 p.m. on Sunday (which games may be separated by a large number of intervening games). Alternatively, a player might play the lottery-type game relative to a first game played at a first gaming machine and a second game which is played at a second gaming machine or in a keno lounge, etc. In such configurations, the player's selected set of indicia and the selected games and their outcomes may be tracked to determine the outcome of the lottery-type game (either by paper selections, electronic storage of the player's selections—such as in association with a player tracking account or the like).

It is noted that the two or more games which are presented or played relative to the lottery-type game may be associated with base wagering games but not comprise the base wagering games themselves. For example, a player might elect to play a number of video slot games at a gaming machine. When the player plays a video slot game, an associate game event may occur, such as the selection of keno balls, bingo balls or other numbers or the like, such as via a separate RNG. The outcome of that associated game event may comprise the first base game which is used as part of the lottery-type event. Thus, a player might wager upon and play two video slot games. Associated first and second base game events may occur or be generated relative to those slot games, which first and second base game events are evaluated to determine a lottery-type game event outcome. This embodiment is particularly beneficial relative to base games which themselves do not readily translate to lottery-type results, such as slot type games. As one example, a video slot game may be modified, such as with a secondary controller, so that when a player elects to play the lottery-type game, each video slot game triggers an associate base game event. As indicated above, such a base game event may be a keno type game event or the like, wherein balls or numbers are selected and compared to player numbers. The balls or numbers may be selected via an RNG which is associated with the secondary controller, whereby each base game is actually implemented by the secondary controller relative to the original video poker games on the gaming machine (but by which a player is still presented a lottery-type game event which is based upon two or more base games or events).

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine adapted to present a lottery game relative to two or more primary casino game comprising:

a plurality of gaming machine peripheral devices including at least one video display, a wager accepting device configured to accept a physical item representing monetary value for establishing a credit balance at said gaming machine and at least one player input device;

a main game controller communicating with said plurality of gaming machine peripheral devices and configured to:

receive at least one casino game wager from said player from said credit balance;

present a first casino wagering game comprising displaying at least a first set of indicia to said player via said at least one video display; and presenting a first casino wagering game comprising displaying at least a first set of indicia to said player via a display of said gaming device;

award first winnings to said player if an outcome of said first casino wagering game is a winning outcome;

present a second casino wagering game comprising displaying at least a second set of indicia to said player via said display of said gaming device; and award second winnings to said player if an outcome of said second casino wagering game is a winning outcome; and a secondary controller communicating with said plurality of gaming machine peripheral devices and configured to:

monitor said presentation of said first and second casino games by said main game controller;

determine, regardless of whether said outcomes of said first and/or second casino wagering games are winning or losing, if a lottery winning outcome has occurred comprising determining if designated indicia comprising at least one indicia from said first set of indicia and at least one indicia from said second indicia match a selected set of indicia; and award lottery winnings to said player if said lottery winning outcome has occurred.

2. The gaming machine in accordance with claim 1 further comprising said secondary controller receiving input from said player of a selection of said selected set of indicia via said at least one player input device of said gaming machine.

3. The gaming machine in accordance with claim 1 wherein said secondary controller is configured to receive at least one lottery game wager from said player.

4. The gaming machine in accordance with claim 1 wherein said first casino wagering game comprises a poker game and said first set of indicia comprises at least a first set of cards and said second casino wagering game comprises a poker game and said second set of indicia comprises at least a second set of cards.

5. The gaming machine in accordance with claim 4 wherein said designated indicia comprises at least one card from said first set of cards and at least one card from said second set of cards and said selected indicia comprises a number of cards independently selected by said player, the number of cards being the same in number as said designated indicia.

6. The gaming machine in accordance with claim 1 comprising said secondary controller determining if said designated indicia match said selected indicia on a position by position comparison.

7. The gaming machine in accordance with claim 4 wherein said designated indicia comprise five cards from said first set of cards and a single card from said second set of cards.

8. The gaming machine in accordance with claim 1 wherein said first casino wagering game comprises a first keno game and said second casino wagering game comprises a second keno game.

9. The gaming machine in accordance with claim 8 wherein said selected indicia comprise a set of keno numbers.

10. The gaming machine in accordance with claim 8 further comprising receiving a player's selection of a first set of keno numbers corresponding to said first keno game and a selection of a second set of keno numbers corresponding to said second keno game, said first set of indicia comprises a first set of drawn keno numbers for matching to said player's first set of keno numbers, and said second set of indicia comprises a second set of drawn keno numbers for matching to said player's second set of keno numbers.

11. The gaming machine in accordance with claim 10 wherein said designated indicia comprise at least one of said numbers from said first set of keno numbers and at least one of said numbers from said second set of keno numbers and said selected set of indicia comprises a corresponding number of numbers from said first and second sets of drawn keno numbers.

12. The gaming machine in accordance with claim 10 wherein said designated indicia comprises a first five numbers from said first set of keno numbers and a first number from said second set of keno numbers and said selected set of indicia comprises a first five numbers from said first set of drawn keno numbers and a first number from said second set of drawn keno numbers.

13. The gaming machine in accordance with claim 1 wherein said at least one casino game wager comprises a first wager corresponding to said first casino wagering game and a second wager corresponding to said second casino wagering game.

* * * * *